US010428567B2

(12) United States Patent
Balay et al.

(10) Patent No.: US 10,428,567 B2
(45) Date of Patent: Oct. 1, 2019

(54) MULTI-PANEL STACKING OVERHEAD DOOR

(71) Applicant: CIW Enterprises, Inc., Mountaintop, PA (US)

(72) Inventors: Thomas Balay, Drums, PA (US); Joseph Balay, Sugarloaf, PA (US); Ian Klish, Nanticoke, PA (US)

(73) Assignee: CORNELLCOOKSON, LLC, Mountaintop, PA (US)

( * ) Notice: Subject to any disclaimer, the term of this patent is extended or adjusted under 35 U.S.C. 154(b) by 203 days.

(21) Appl. No.: 15/294,408

(22) Filed: Oct. 14, 2016

(65) Prior Publication Data

US 2018/0106086 A1 Apr. 19, 2018

(51) Int. Cl.

| | |
|---|---|
| ***E06B 1/52*** | (2006.01) |
| ***E05D 15/24*** | (2006.01) |
| ***E05F 15/60*** | (2015.01) |
| *E05D 15/18* | (2006.01) |
| *E05F 15/681* | (2015.01) |
| *E05F 15/686* | (2015.01) |

(52) U.S. Cl.

CPC ..... *E05D 15/24* (2013.01); *E05F 15/60* (2015.01); *E06B 1/522* (2013.01); *E05D 15/18* (2013.01); *E05F 15/681* (2015.01); *E05F 15/686* (2015.01); *E05Y 2800/122* (2013.01); *E05Y 2900/10* (2013.01)

(58) Field of Classification Search

CPC ..... E06B 3/925; E06B 9/0638; E06B 9/0676; E06B 2009/588; E05D 15/24; E05D 15/262; E05D 15/242; E05Y 2900/10; E05F 15/60

USPC ..... 160/40

See application file for complete search history.

(56) References Cited

U.S. PATENT DOCUMENTS

| | | | | |
|---|---|---|---|---|
| 2,031,847 | A | 2/1936 | Naylor | |
| 2,037,085 | A | 4/1936 | Naylor | |
| 2,323,585 | A | 7/1943 | Deuring | |
| 2,409,037 | A * | 10/1946 | Guth | E06B 3/01 160/113 |
| 2,523,844 | A * | 9/1950 | Rohrman | E06B 3/925 160/202 |
| 2,679,290 | A | 5/1954 | Monaghan et al. | |
| 2,786,523 | A | 3/1957 | Phillips | |
| 2,951,533 | A * | 9/1960 | Lucas | E06B 3/485 160/201 |
| 3,280,888 | A | 10/1966 | Davis | |
| 3,304,994 | A * | 2/1967 | Kozak | E06B 3/925 160/193 |

(Continued)

*Primary Examiner* — Katherine W Mitchell
*Assistant Examiner* — Abe Massad
(74) *Attorney, Agent, or Firm* — Mitchell A. Smolow

(57) ABSTRACT

A multi-panel overhead stacking door which allows for the addition of multiple panels across an opening width. A vertical extrusion acts a guide for the panel above and/or below it. The vertical extrusion serves as a moving guide which thereby allows for the relatively easy addition of multiple panels. At each end of the door is a series of formed parts that are attached to the ends of the end panels and movably maintained with door guides. The assembled door is driven by, for example, a driven shaft, positioned at the top of or above the door opening. The shaft comprises drums to windingly and unwindingly receive a lifting member. The lifting member runs from the drum to the bottom panel assembly behind each vertical extrusion.

19 Claims, 15 Drawing Sheets

(56) References Cited

U.S. PATENT DOCUMENTS

| | | | | | |
|---|---|---|---|---|---|
| 3,313,338 | A * | 4/1967 | Knight | E06B 3/925 | 160/189 |
| 3,378,059 | A | 4/1968 | Young | | |
| 3,757,845 | A | 9/1973 | Pagliaro | | |
| 3,927,709 | A | 12/1975 | Anderson et al. | | |
| 4,083,148 | A * | 4/1978 | Saucier | E06B 3/28 | 49/125 |
| 4,332,287 | A * | 6/1982 | Stolpe | E06B 9/11 | 160/133 |
| 4,852,300 | A | 8/1989 | Keast | | |
| 5,235,724 | A | 8/1993 | Perrin | | |
| 5,555,923 | A * | 9/1996 | Leist | E06B 3/485 | 160/229.1 |
| 5,611,382 | A * | 3/1997 | Sferra | E06B 9/52 | 160/113 |
| 5,927,368 | A * | 7/1999 | Rohrer | E05D 15/165 | 160/201 |
| 6,006,817 | A | 12/1999 | Stone et al. | | |
| 6,041,847 | A * | 3/2000 | Lai | E06B 3/485 | 160/235 |
| 6,073,674 | A | 6/2000 | Hormann | | |
| 6,311,757 | B1 * | 11/2001 | Schuette | E06B 9/0676 | 160/202 |
| 6,860,311 | B1 * | 3/2005 | Minor | E05D 15/18 | 160/193 |
| 7,040,373 | B2 * | 5/2006 | Snyder | E06B 3/485 | 160/113 |
| 7,089,989 | B2 | 8/2006 | Pfender | | |
| 8,327,908 | B2 | 12/2012 | Godovalov | | |
| 2003/0047293 | A1 * | 3/2003 | Lee | E06B 3/72 | 160/236 |
| 2012/0211177 | A1 * | 8/2012 | Fletcher | E05D 15/165 | 160/201 |

* cited by examiner

MULTI-PANEL STACKING OVERHEAD DOOR

FIELD OF THE INVENTION

This invention relates generally to overhead doors and in particular, to multi-panel stacking overhead doors.

BACKGROUND OF THE INVENTION

Overhead doors are utilized to provide security and access control in institutional, industrial and commercial buildings. They fall into two general design categories: coiling doors and segmented panel doors. Each have their advantages and disadvantages making one better suited for a given design application.

Often times a segmented panel door is better suited for a particular application but cannot be used due to the increased space requirement needed to house the panels once the door is opened. Various attempts have been made to reduce the profile of the opened door. Known panel stacking designs maintain a fixed connection point between the panels such as a hinge, or otherwise fixedly link the opened panels, for example, with chains, to support the weight of the panels during opening.

Having to maintain a fixed connection point between the panels presents many disadvantages such as placing limitations on the ease of repair of damaged panels and requiring higher energy consuming operators to open the door. Accordingly, there is still a continuing need for improved stacking panel overhead door designs. The present invention fulfills this need and further provides related advantages.

BRIEF SUMMARY OF THE INVENTION

The multi-panel overhead stacking door of the present invention allows for the addition of multiple panels across an opening width. It does not require one continuous piece of material to span the opening.

A vertical extrusion acts a guide for the panel above and/or below it. The vertical extrusion serves as a moving guide which thereby allows for the relatively easy addition of multiple panels. At each end of the door is a series of formed parts that are attached to the ends of the end panels and movably maintained with door guides.

The assembled door is driven by, for example, a driven shaft, for example, a motor driven shaft, positioned at the top of or above the door opening. The shaft comprises drums to windingly and unwindingly receive a lifting member comprising, for example, cables, belts, and chains. The lifting member runs from the drum to the bottom panel assembly behind each vertical extrusion.

One advantage of the present invention is the relative ease to remove or repair a damaged panel.

Another advantage is that the winding shaft can be supported at each drum and does is not required to be enclosed in a larger pipe for support as do standard rolling steel doors.

Other features and advantages of the present invention will be apparent from the following more detailed description of the preferred embodiments taken in conjunction with the accompanying drawings which illustrate by way of example the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1:
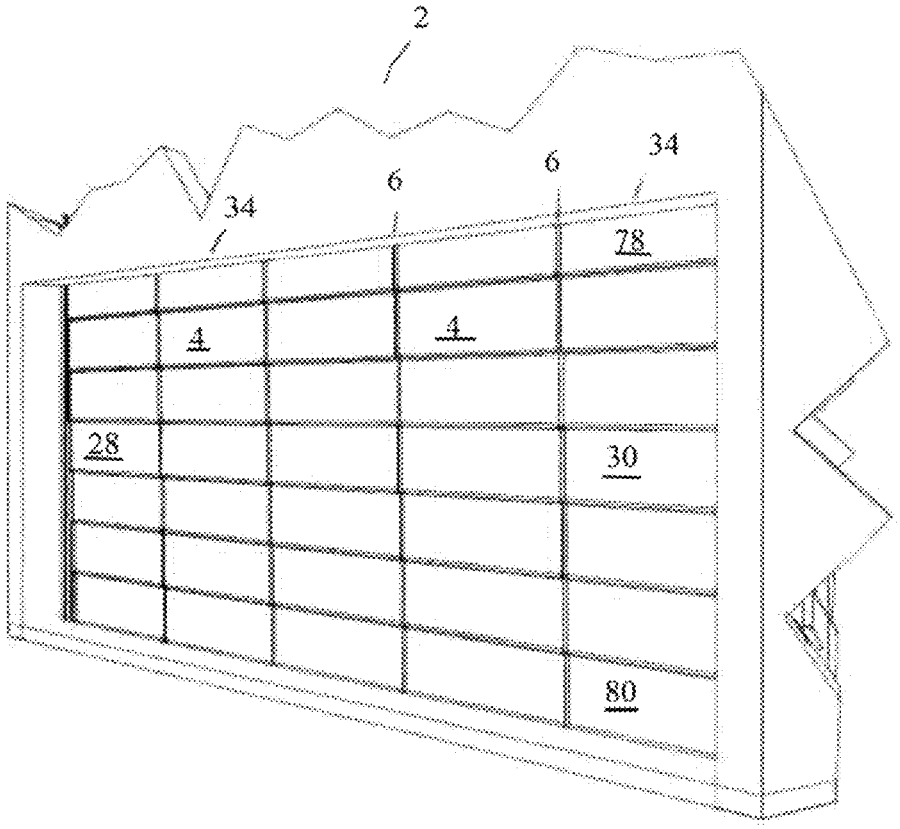
FIG. 1 is a perspective view of a closed multi-panel stacking overhead door.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

Turning now to the figures, FIG. 1 depicts a closed multi-panel stacking overhead door 2 described in detail below. The door 2 comprises a plurality of panels 4, for example, framed panels. Each panel vertical stack 34 is separated from a neighboring stack by a plurality of vertical extrusions 6.

Figure 2:
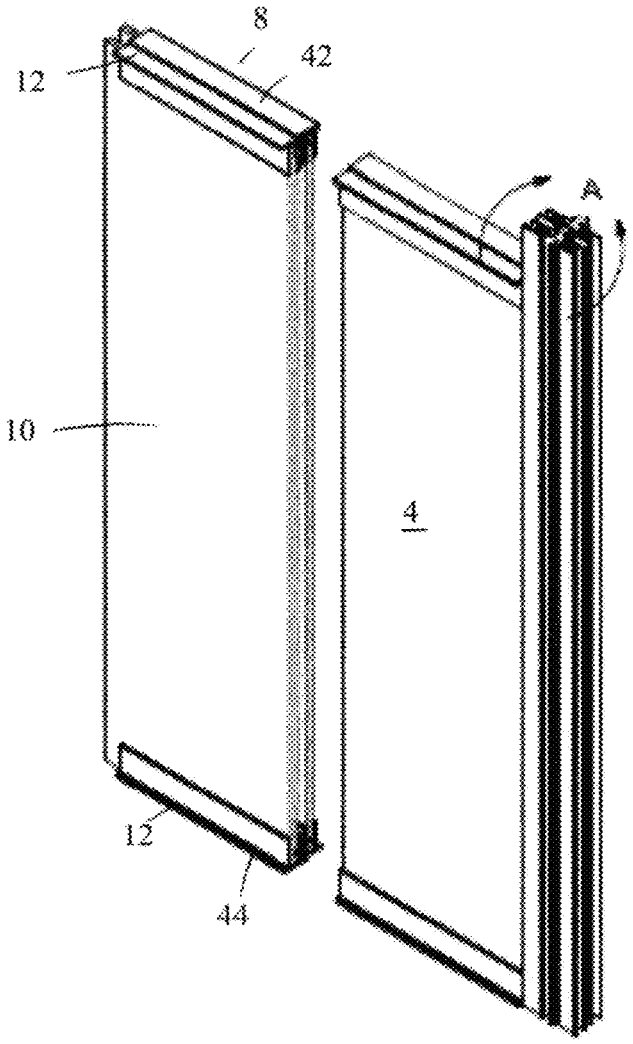
FIG. 2 is a perspective view of a panel engaging a vertical extrusion.
Figure 3:
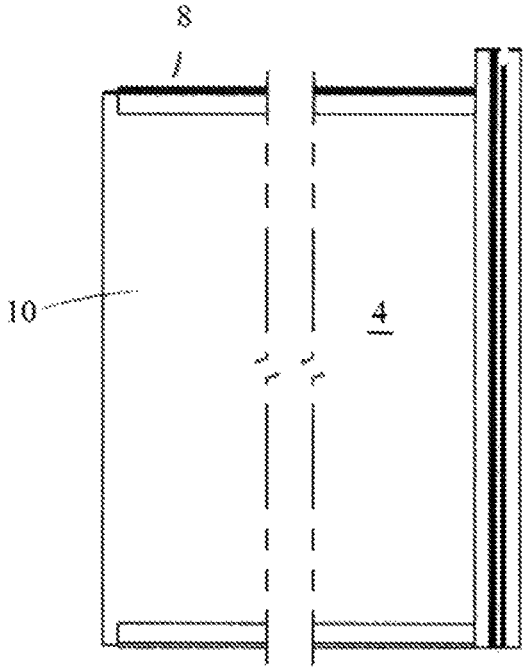
FIG. 3 is a front view of the panel of the panel of FIG. 2.
Figure 4:
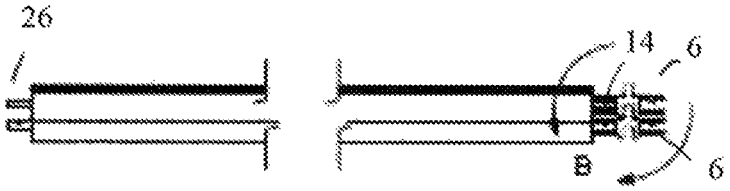
FIG. 4 is a top view of the panel of FIG. 3.

FIGS. 2-4 depict a framed panel 4 comprising a frame 8 encasing a panel material 10, for example polycarbonate, glass, insulated PVC, or metal. The frame geometry includes a frame tab 12 which extends from the panel 4.

Figure 5:
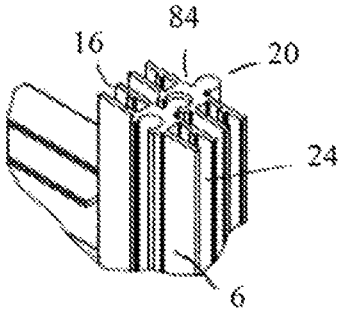
FIG. 5 is a perspective view of detail A of FIG. 2.
Figure 6:
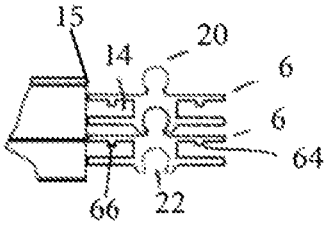
FIG. 6. Is a top view of detail B of FIG. 4.
Figure 7:
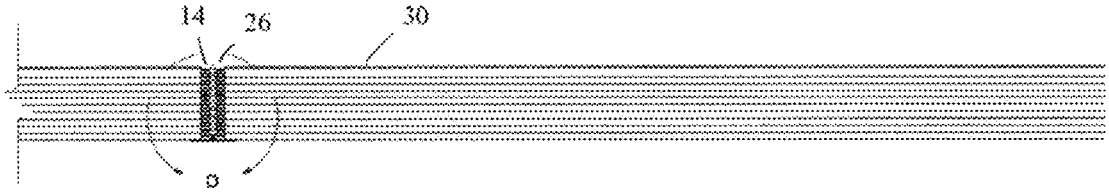
FIG. 7 is a top view of a panel vertical stack.

Turning now to FIGS. 5 and 6, a first panel first side frame tab 14 is retentively received by a first vertical extrusion slot 16 in a mating vertical extrusion 6. The vertical extrusion 6 extends from a distal edge surface 15 of the panel 4 and further comprises a nesting section 84 comprising a male section 20 and a female section 22 which separates the first vertical extrusion slot 16 from a second vertical extrusion slot 24. The second side frame tab 26 of an adjacent panel (FIG. 7) is retentively received by the second vertical extrusion slot 24 and fixed to the vertical extrusion 6, for example, with a fastener, or preferably, with a step 64 and groove 66 described in detail below.

Figure 8:
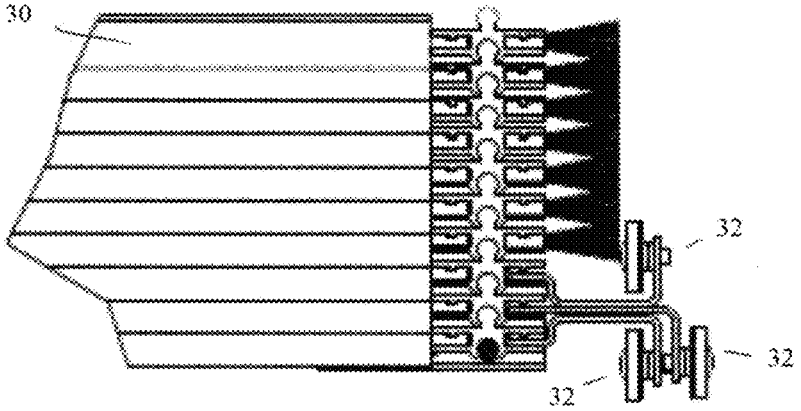
FIG. 8 a top view of stacked end panels.
Figure 9:
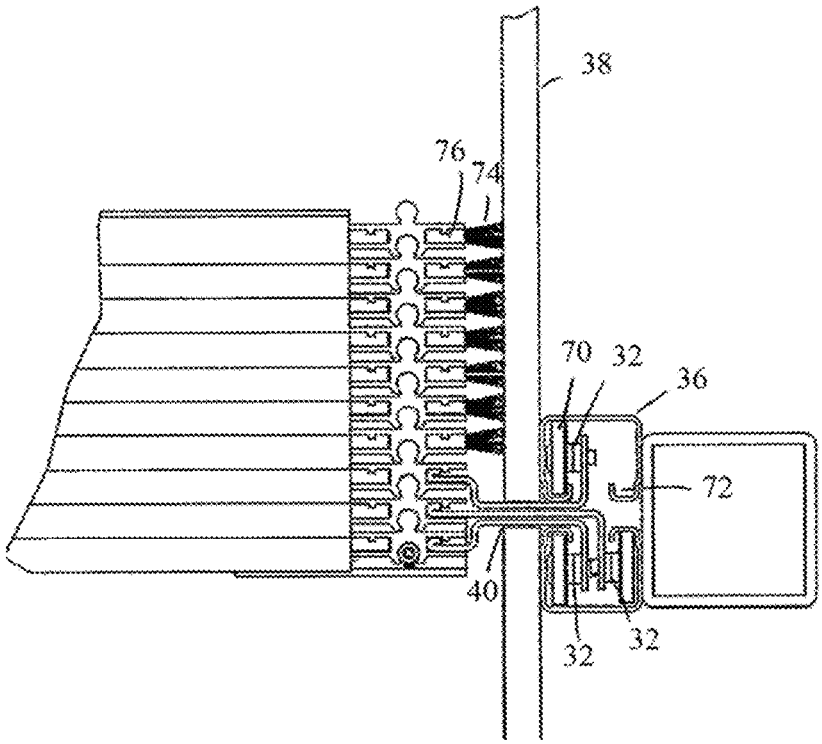
FIG. 9 is a top view of the panel ends.

FIGS. 8 and 9 depicts a preferred embodiment. When a panel 10 is an end panel 28, 30 (FIG. 1) having no adjacent panel, one or more panels have a panel retaining member 32 fixed to the panel-less vertical extrusion slot. Preferably the retaining member is fixed by retainingly engaging the step 64. As depicted in FIG. 9, vertical retaining members 32 within a vertical stack have a respective geometry to nest down into a retaining guide 36. One or more vertical retaining member 32 comprises a rolling member 70 rollingly retained within a retaining guide 36 comprising at least one rolling guide track 72. Preferably, each vertical retaining member 32 is rollingly retained within its own rolling guide track 72, as depicted in FIG. 9.

End panels not fixed to a retaining member 32 optionally have a weather seal 74 fixed to the panel-less vertical extrusion slot. Preferably the weather seal 74 is also fixed by retainingly engaging the step 64, for example, by engaging a weather strip groove 76. The weather strip comprise, for example, a brush or a brush/flexible strip combination.

Optionally, the retaining guide 36 is hidden behind a wall 38. Wall slot 40 allows for through passage of the retaining members 32. Respective retaining member 32 geometry inhibits lateral displacement of the door 2 and further allows the members 37 to nest when the door 2 is in an open position.

Preferably a rolling member is included on at least the bottom panel 4, most preferably, having at least two rolling members 70. For maximum resistance to displacement pressure panel retaining members 32 are utilized on all end panels. For each retaining member 32 added, the wider the retaining guide gap has to be. When used with standard 2 foot high panels ideally the panel retaining members 32 are used on the bottom three panels because above 6 feet it is harder to displace the door. Placing panel retaining members 32 on the bottom three panels minimized the retaining guide gap while providing adequate resistance to door displacement.

Figure 9A:
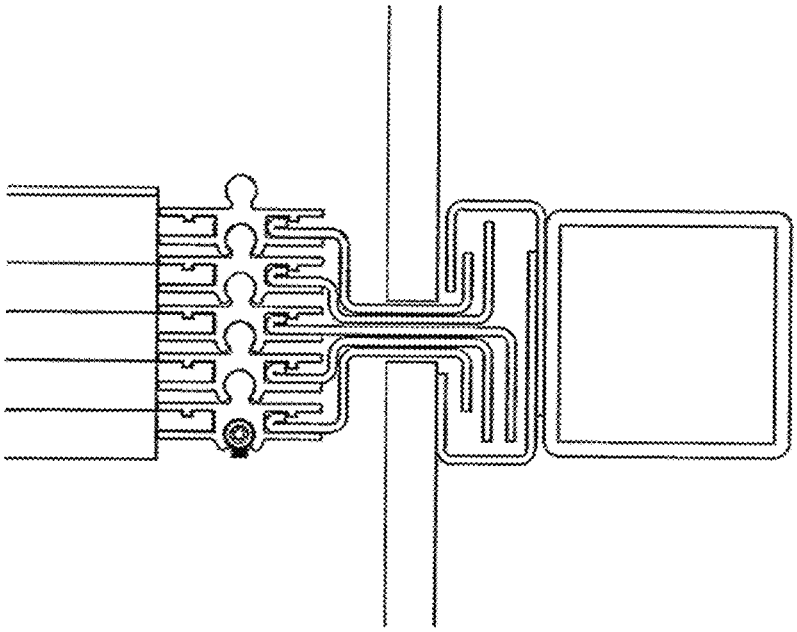
FIG. 9*a* is a top view of an alternate embodiment of stacked end panels.
Figure 10:
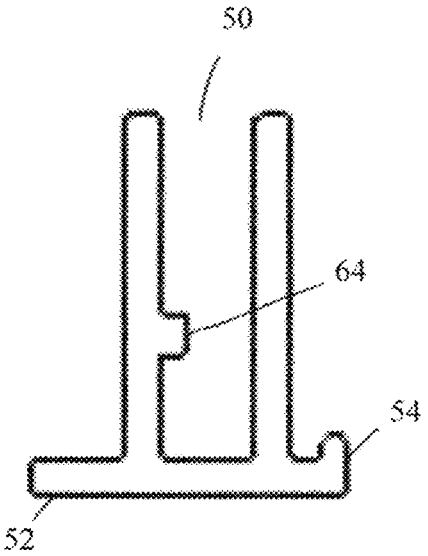
FIG. 10 is end view of a horizontal extrusion.

Alternatively, the rolling members 70 may be omitted as depicted in FIG. 9*a*.

Figure 11:
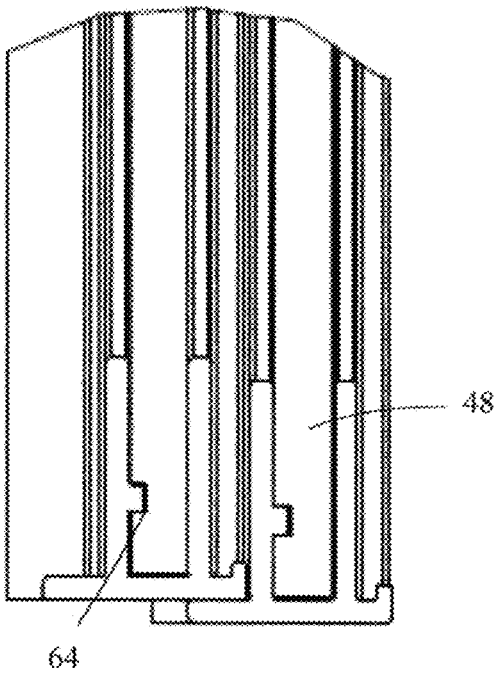
FIG. 11 is an end view of engaged horizontal extrusion shelf catching hooks.
Figure 12:
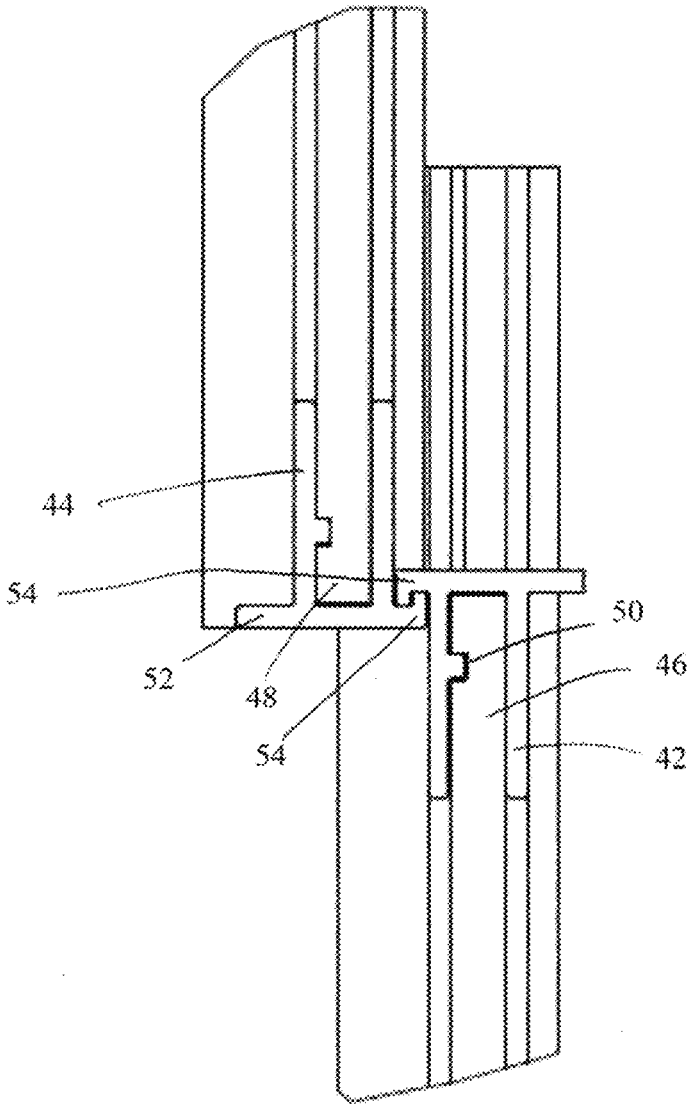
FIG. 12 is an end view of engaged horizontal extrusion catching hooks.
Figure 13:
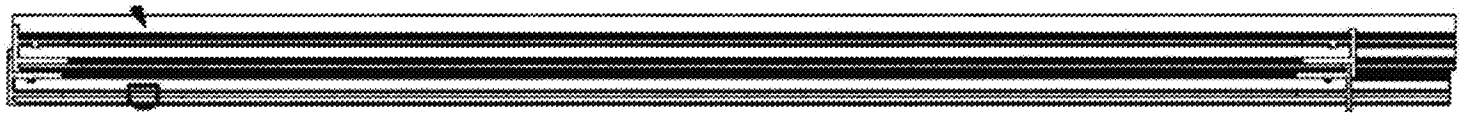
FIG. 13 is an end view of stacked panels.
Figure 14:
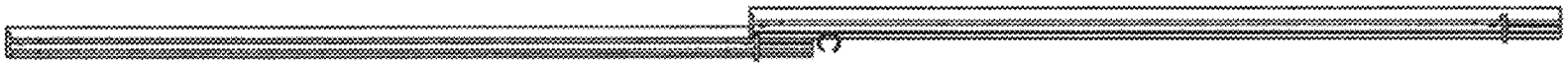
FIG. 14 is an end view of unstacked panels.

Turning now to FIGS. 2, 3 and 10-12, a top 42 and bottom 44 horizontal extrusion is fixed to a panel 4. Preferably, top and bottom horizontal extrusions 42, 44 comprise a horizontal extrusion slot 50 (FIG. 10) which receives either a top frame tab 46 or bottom frame tab 48, as appropriate. FIG. 11 depicts the geometry used for both. Each horizontal extrusion further includes a horizontal extrusion shelf 52 and a horizontal extrusion catching hook 54, operationally depicted in FIGS. 11 and 12. Preferably, a step 64 serves as a mating member with the panel material 10. The panel material 10 comprises a groove 66 to accept the step 64.

Figure 15:
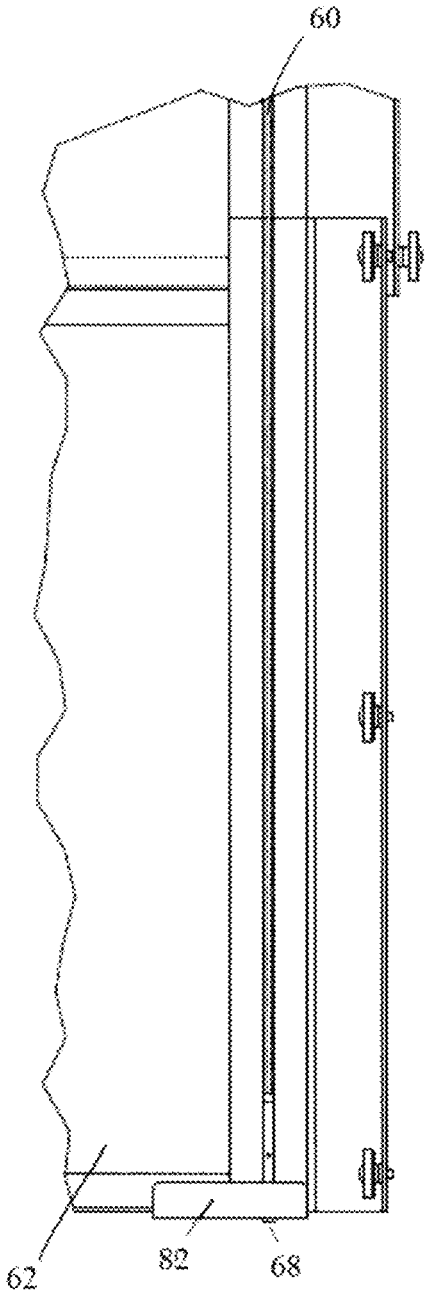
FIG. 15 is a view of the bottom right hand corner of the door from the interior side.

FIG. 15 shows the bottom right hand corner of the door as viewed from the store (interior) side. A door lifting apparatus 60 comprising, for example, a drive shaft (not shown), preferably a motor driven shaft, fixed to the building at the top of or above the door opening. The shaft comprises a winding member (not shown), for example, drums, to windingly and unwindingly lift and lower a lifting member 62, connected by, for example, cables, belts, and chains. The lifting member 62 is preferably the bottom panel 80 (FIG. 1). At the very bottom of the door 2 is a lifting apparatus adjustment member 68, for example, a cable termination that is concealed at the bottom of the door 2 in the female section 22 of the vertical extrusion 6. A force displacement member 82, for example, a small angle is used to displace some of the lifting force, for example, cable tension, across the bottom of the bottom panel 80.

FIGS. 9-21 will further aid in understanding the operation of the multi-panel staking overhead door.

In the down position (FIGS. 1, 12, 14, and 16), the winding member is unwound. Within each panel vertical stack 34 a lower panel hangs from the panel directly above it as their respective bottom and top horizontal extrusion catching hooks 54 engage. In the preferred embodiment the lifting member 62 is the bottom panel 80 comprising a wire rope end attached to it. The top panel 78 of the door does not move, it remains stationary, being permanently affixed to the building structure. As the bottom panel 80 is lowered, the entire stack of panels moves with it until each horizontal extrusion catching hook 54 catches its respective hook from the panel before it.

Figure 16:
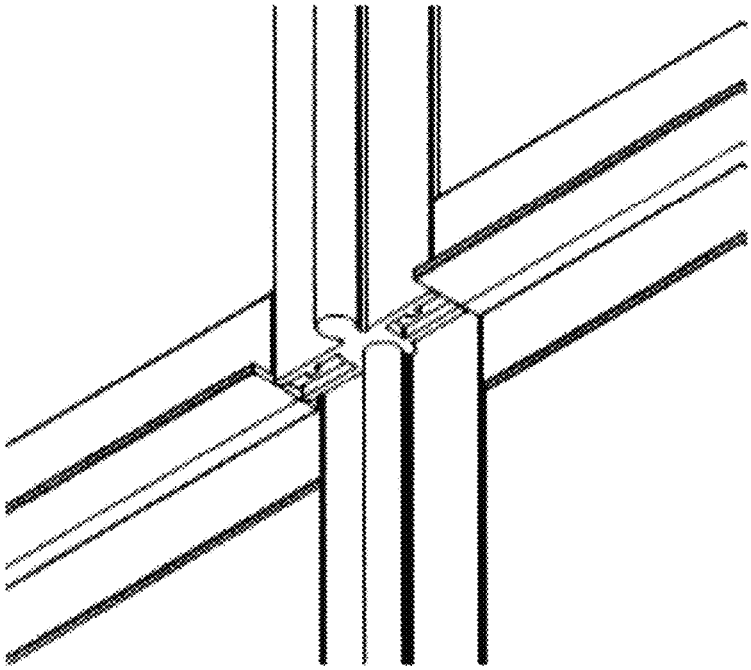
FIG. 16 is a perspective view of adjacent door panels in a closed position.

To open the door, as the drive shaft winds the lifting member 60 onto the winding member the bottom panel 80 is lifted disengaging the bottom and top horizontal extrusion catching hooks 54 from their respective panels, and the bottom panel vertical extrusion male section 20 slides within the vertical extrusion female section 22 of the panel directly above (FIG. 16).

As the bottom panel 80 continues to lift eventually the top horizontal extrusion catching hook portion of the bottom panel engages the horizontal extrusion shelf 52 of panel directly above and begins to lift that panel (the one directly above), thereby disengaging that panel's top horizontal extrusion catching hook from the bottom horizontal extrusion catching hook of the panel from which hangs. Further aiding the lifting process and helping to support the lifted panels, the bottom horizontal shelf portion of the lower panel engages the bottom horizontal extrusion catching hook portion of the panel immediately above (from which it had been hanging).

Figure 17:
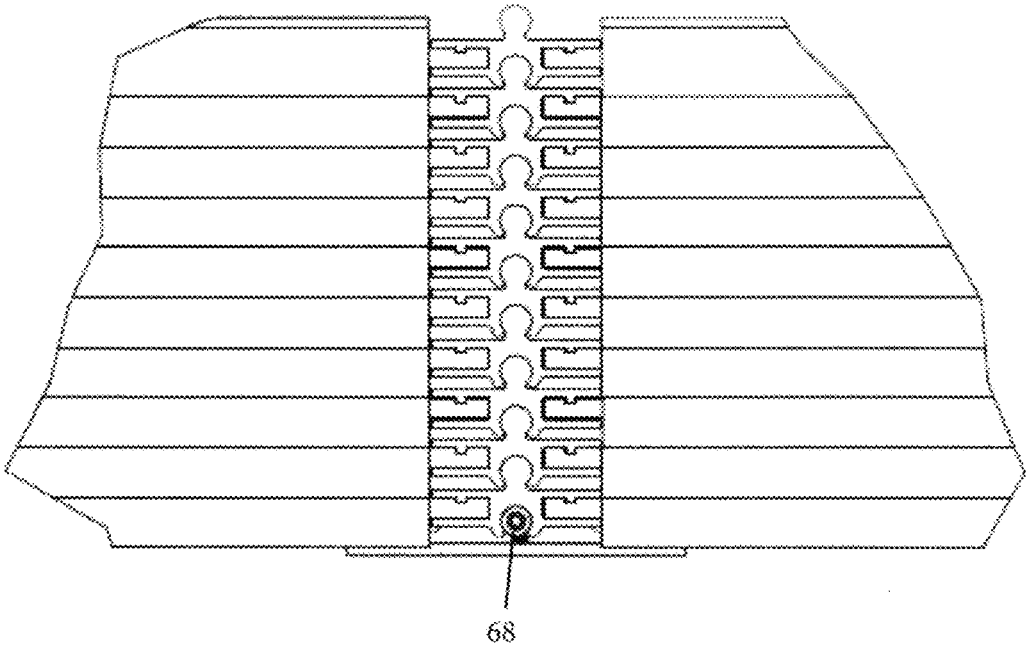
FIG. 17 is a top view of nested vertical extrusions, detail D of FIG. 7.
Figure 18:
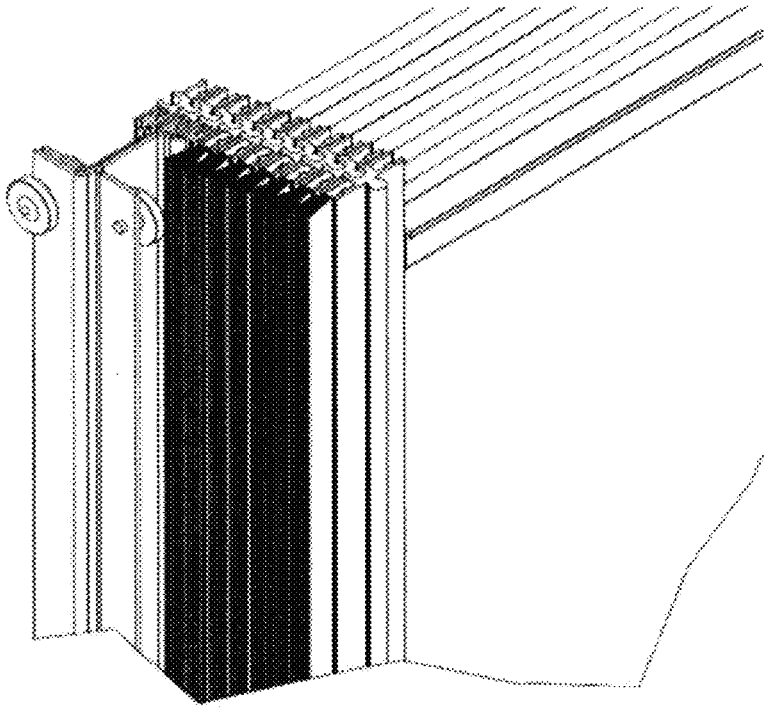
FIG. 18 is a perspective view of nested end panels.
Figure 19:
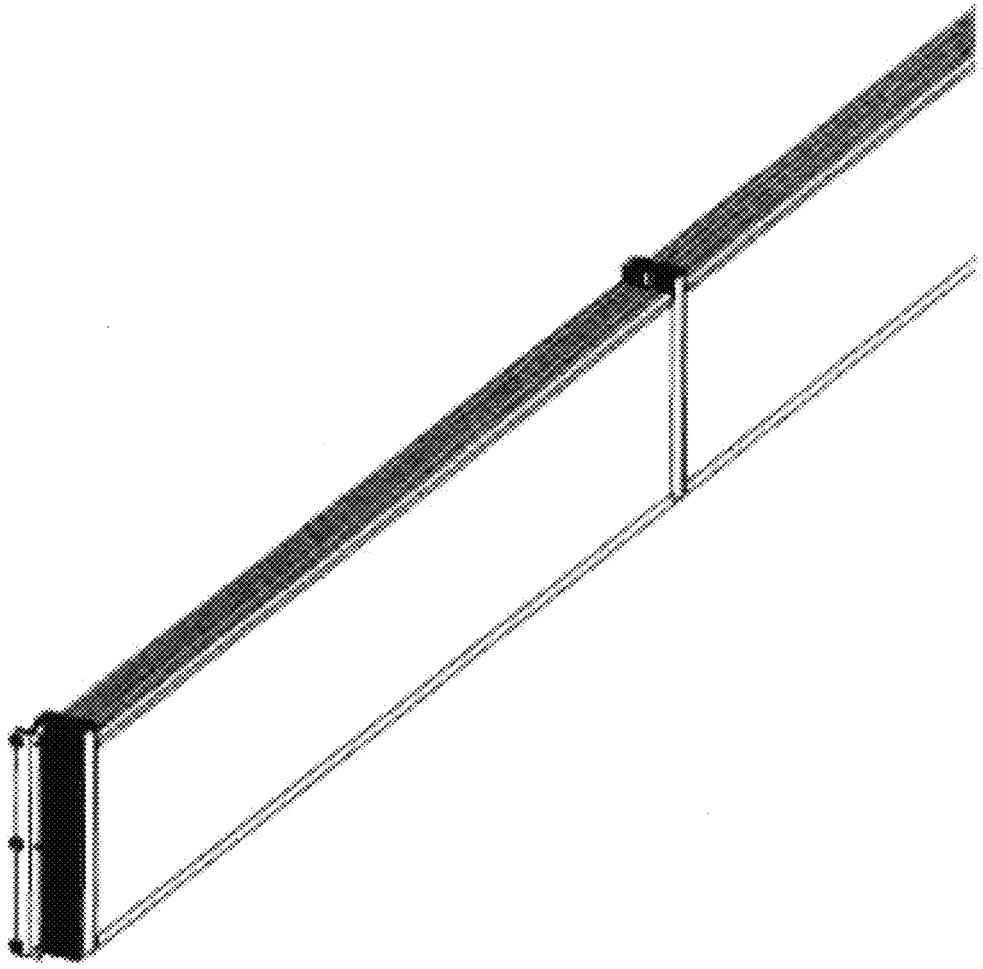
FIG. 19 is a perspective view of multiple vertical panel stacks.

The process repeats itself until the door is fully open with the panels stacked and supported, shown in FIGS. 17-19. As the panels stack the geometry of the respective panel retaining members 32 stack within the wall slot 40 and nest within the retaining guide 36.

Figure 20:
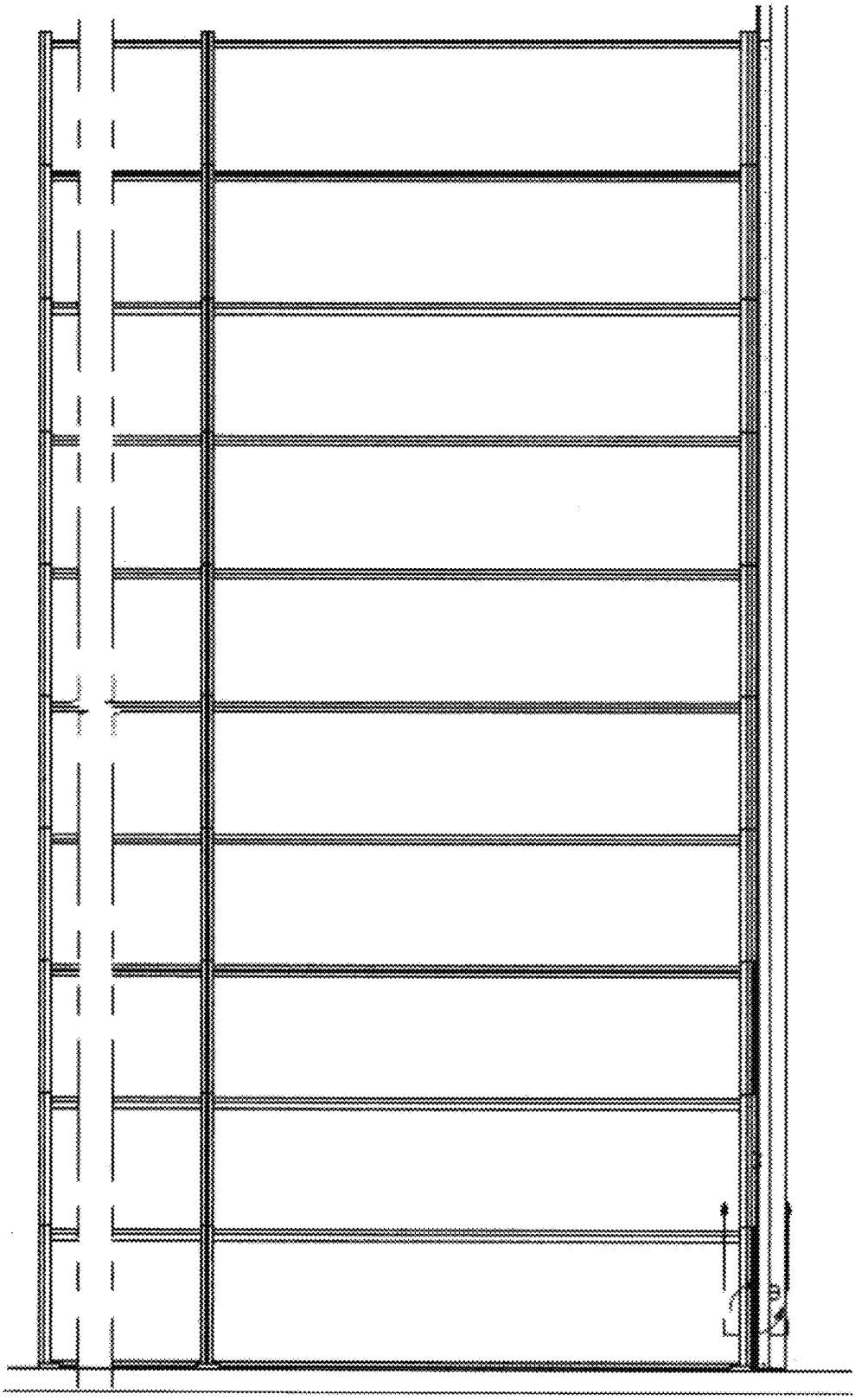
FIG. 20 is a front view of an unstacked vertical panel stack.
Figure 21:
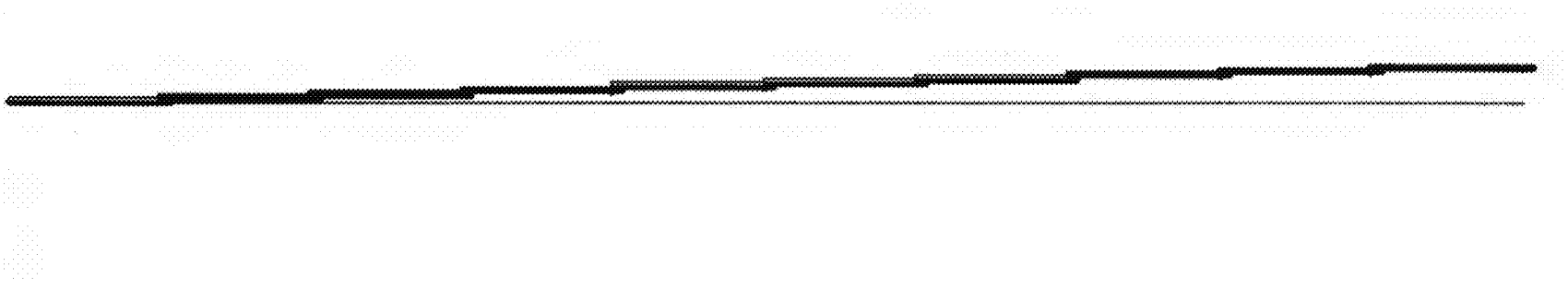
FIG. 21 is an end view of an unstacked vertical panel stack.

To close the door the process is reversed. As the drive shaft unwinds the door closes as the entire stack begins to drop and one panel at a time is disengaged and left hanging until the one below it does the same. The bottom panel drops by gravity thereby disengaging the bottom horizontal extrusion shelf 52 and the top horizontal extrusion catching hook portion from the panel above until eventually their respective top and bottom horizontal extrusion hooks engage (FIGS. 20 and 21). The disengagement/engagement proceeds sequentially as the nested panels gravity fall. At no time does the vertical extrusion male section 20 of a lower panel disengage from the vertical extrusion female section 22 of the panel directly above.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A multi-panel stacking door system comprising:

a first and second door retaining guide located at a respective first and second door end;

a door lifting apparatus; and a plurality of panel stacks, each stack comprising a plurality of panels including a top panel and a bottom panel;

wherein the plurality of panel stacks includes a first and second end stack, each end stack plurality of panels comprising a plurality of end panels;

wherein a respective top horizontal extrusion affixed to the top of each panel; a respective bottom horizontal extrusion affixed to the bottom of each panel; and a respective first and a respective second individual vertical extrusion affixed to a respective first and a respective second side of each panel form a respective frame encasing each panel; the frame comprising a frame tab;

wherein;

at least one of the top panels is fixed in position to remain stationary;

each vertical extrusion extends from a distal edge surface of the panel in a direction substantially parallel a plane defined by the panel and comprises a first vertical extrusion slot and a second vertical extrusion slot separated by a nesting section;

each top and bottom horizontal extrusion comprises a horizontal extrusion shelf and a horizontal extrusion catching hook; and at least one vertical extrusion of the first end stack is retained by a retaining member within the first door retaining guide and at least one vertical extrusion of the second end stack is retained by a different retaining member within the second door retaining guide.

2. The door system of claim 1 wherein every panel comprises a first and second side frame tab retentively inserted into the respective vertical extrusion slot such that the vertical extrusion retentively separates two horizontal adjacent panels; and further comprises a top and bottom frame tab retentively inserted in a respective top and bottom horizontal extrusion slot such that the top and bottom horizontal extrusions retentively separate two vertical adjacent panels; and in each end stack at least one end panel vertical extrusion slot retentively retains the retaining member.

3. The door system of claim 2 wherein each of the side frame tabs are retentively engaged by a respective side tab groove and a vertical extrusion step; the top frame tab is retentively engaged by retentive engagement of a respective top tab groove and top horizontal extrusion step; the bottom frame tab is retentively engaged by retentive engagement of a respective bottom tab groove and bottom horizontal extrusion step; and the retaining member is retentively engaged by a panel-less vertical extrusion step.

4. The door system of claim 3 wherein each end stack comprises a plurality of retaining members wherein each retaining member has a respective geometry to nest within a respective retaining guide.

5. The door system of claim 4 wherein at least one retaining member rollingly, retentively engages a retaining guide rolling guide track.

6. The door system of claim 2 further comprising at least one weather seal retentively fixed to the panel-less vertical extrusion slot.

7. The door system of claim 2 wherein the nesting section comprises a male section and a female section.

8. The door system of claim 4 wherein the lifting apparatus comprises the bottom panel as a lifting member.

9. A multi-panel stacking door comprising:

a plurality of panel stacks, each stack comprising a plurality of panels including a top panel and a bottom panel;

wherein the plurality of panel stacks includes a first and second end stack, each end stack plurality of panels comprising a plurality of end panels;

wherein a respective top horizontal extrusion affixed to the top of each panel; a respective bottom horizontal extrusion affixed to the bottom of each panel; and a respective first and a respective second individual vertical extrusion affixed to a respective first and a respective second side of each panel form a respective frame encasing each panel; the frame comprising a frame tab;

wherein;

each vertical extrusion extends from a distal edge surface of the panel in a direction substantially parallel a plane defined by the panel and comprises a first vertical extrusion slot and a second vertical extrusion slot separated by a nesting section; and each top and bottom horizontal extrusion comprises a horizontal extrusion shelf and a horizontal extrusion catching hook.

10. The door system of claim 9 wherein every panel comprises a first and second side frame tab retentively inserted into the respective vertical extrusion slot such that the vertical extrusion retentively separates two horizontal adjacent panels; and further comprises a top and bottom frame tab retentively inserted in a respective top and bottom horizontal extrusion slot such that the top and bottom horizontal extrusions retentively separate two vertical adjacent panels; and in each end stack at least one end panel vertical extrusion slot retentively retains a retaining member.

11. The door system of claim 10 wherein each of the side frame tabs are retentively engaged by a respective side tab groove and a vertical extrusion step; the top frame tab is retentively engaged by retentive engagement of a respective top tab groove and top horizontal extrusion step; and the bottom frame tab is retentively engaged by retentive engagement of a respective bottom tab groove and bottom horizontal extrusion step.

12. The door system of claim 11 wherein the retaining member has a geometry for nesting within a retaining guide.

13. The door system of claim 12 wherein at least one of the retaining member has a geometry for rollingly, retentively engaging a retaining guide rolling guide track.

14. The door system of claim 10 further comprising at least one weather seal retentively fixed to the panel-less vertical extrusion slot.

15. The door system of claim 10 wherein the nesting section comprises a male section and a female section.

16. A method for raising a multi-panel stacking door comprising the steps of:

a) installing a first and second door retaining guide;

b) installing a door lifting apparatus having a lifting member;

c) installing a multi-panel stacking door comprising:

a plurality of panel stacks, each stack comprising a plurality of panels including a top panel and a bottom panel;

wherein the plurality of panel stacks includes a first and second end stack, each end stack plurality of panels comprising a plurality of end panels;

wherein a respective top horizontal extrusion affixed to the top of each panel; a respective bottom horizontal extrusion affixed to the bottom of each panel; and a respective first and a respective second individual vertical extrusion affixed to a respective first and a respective second side of each panel form a respective frame encasing each panel; the frame comprising a frame tab;

wherein;

each vertical extrusion extends from a distal edge surface of the panel in a direction substantially parallel a plane defined by the panel and comprises a first vertical extrusion slot and a second vertical extrusion slot separated by a nesting section;

each top and bottom horizontal extrusion comprises a horizontal extrusion shelf and a horizontal extrusion catching hook;

at least one vertical extrusion of the first end stack is retained by a retaining member within the first door retaining guide and at least one vertical extrusion of the second end stack is retained by a different retaining member within the second door retaining guide;

such that a lower panel hangs from the panel directly above it as their respective bottom and top horizontal extrusion catching hooks engage;

d) fixing at least one top panel in position to remain stationary;

e) lifting the lifting member thereby disengaging the bottom and top horizontal extrusion catching hooks from their respective panels to nest the panels;

f) continuing to lift the lifting member thereby engaging the top horizontal extrusion catching hook portion of the bottom panel to the horizontal extrusion shelf of the panel directly above to lift that panel, thereby disengaging that panel's top horizontal extrusion catching hook from the bottom horizontal extrusion catching hook of a panel from which hangs;

g) repeating step f) to achieve a desired opening.

17. The method of claim 16 wherein as the top horizontal extrusion catching hook of the bottom panel engages the top horizontal extrusion shelf of the panel directly above, the bottom horizontal extrusion shelf of the bottom panel engages the bottom horizontal extrusion catching hook of the panel directly above.

18. The method of claim 17 further comprising the step of installing a force displacement member; wherein the nesting section comprises a male section and a female section; wherein at no time does the male section of the lower panel disengage from the female section of the panel directly above.

19. The method of claim 16 further comprising the step of lowering the door by lowering the lifting member thereby gravity dropping the lower panel and disengaging the bottom horizontal extrusion shelf and the top horizontal extrusion catching hook from the panel directly above until eventually their respective top and bottom horizontal extrusion hooks engage and the panels hang open.

* * * * *